US006160518A

United States Patent [19]

Miyahara et al.

[11] Patent Number: 6,160,518

[45] Date of Patent: Dec. 12, 2000

[54] DUAL-LOOP MULTIBAND RECEPTION ANTENNA FOR TERRESTRIAL DIGITAL AUDIO BROADCASTS

[75] Inventors: Shunji Miyahara; Naoki Shibata, both of Yokohama, Japan

[73] Assignee: Visteon Global Technologies, Inc., Dearborn, Mich.

[21] Appl. No.: 09/285,908

[22] Filed: Apr. 2, 1999

[51] Int. Cl.[7] ..... H01Q 1/32

[52] U.S. Cl. ..... 343/713; 343/711

[58] Field of Search ..... 343/711, 713, 343/732, 737, 742, 744, 748, 855, 867

[56] References Cited

U.S. PATENT DOCUMENTS

| | | | |
|---|---|---|---|
| 2,324,462 | 7/1943 | Leeds et al. | 250/11 |
| 3,559,214 | 2/1971 | Altmayer | 343/722 |
| 3,771,159 | 11/1973 | Kawaguchi et al. | 343/729 |
| 3,972,048 | 7/1976 | Davis | 343/711 |
| 4,003,056 | 1/1977 | Davis | 343/704 |
| 4,145,693 | 3/1979 | Fenwick | 343/722 |
| 4,184,164 | 1/1980 | Rod | 343/711 |
| 4,331,961 | 5/1982 | Davis | 343/704 |
| 4,381,566 | 4/1983 | Kane | 455/193 |
| 4,527,164 | 7/1985 | Cestaro et al. | 343/713 |
| 4,791,426 | 12/1988 | Lindenmeier et al. | 343/713 |
| 5,442,368 | 8/1995 | Harada et al. | 343/713 |
| 5,739,794 | 4/1998 | Nagy et al. | 343/713 |

FOREIGN PATENT DOCUMENTS 960759 1/1975 Canada .

OTHER PUBLICATIONS

Screenfix Antenna forDAB, 737 697, 216–237 MHz/1452–1492 MHz, Katnrein Antennen Electronic.

*Primary Examiner*—Hoanganh Le
*Assistant Examiner*—James Clinger
*Attorney, Agent, or Firm*—Mark L. Mollon

[57] ABSTRACT

The invention combines a closed-end loop antenna and an open-end loop antenna in a conformal antenna on the rear window glass of an automotive vehicle above the defogging heater grid. The loops are adapted to receive Digital Audio Broadcasting (DAB) signals in both L band and Band-III frequency bands with maximum sensitivity to vertically polarized signals while requiring minimal space on the window glass. The antenna uses one substantially continuous trace between a pair of antenna feedpoints to achieve low manufacturing cost.

4 Claims, 2 Drawing Sheets

DUAL-LOOP MULTIBAND RECEPTION ANTENNA FOR TERRESTRIAL DIGITAL AUDIO BROADCASTS

BACKGROUND OF THE INVENTION

The present invention relates in general to a multiband antenna, and more specifically to an on-glass automotive antenna having a compact size and performing as a loop antenna at a first digital audio broadcasting (DAB) frequency band and as a quasi-loop antenna at a second DAB frequency band without any switching of antenna elements being required.

Digital audio broadcasting is a broadcast radio service being introduced in many places throughout the world which provides high quality audio and auxiliary data transmissions. One of the most promising applications of DAB is in mobile receivers installed in automotive vehicles, such as cars and trucks.

Various standard transmission protocols, such as Eureka-147, are being established for DAB. European countries and Canada have already begun transmitting terrestrial DAB signals in Eureka-147 format. However, different frequency bands are being designated for DAB service by different governmental authorities around the world. For example, Canadian DAB currently operates in the L-band (from 1452 to 1492 MHz) while European DAB currently operates in Band-III (from 174 to 240 MHz) and L-band.

Depending upon the final decisions that may be taken around the world in selecting frequency bands for DAB systems and depending upon where a particular DAB receiver may be used (e.g., as an automotive vehicle moves between areas), it may be necessary or desirable to receive in both the L-band and Band-III. However, the use of separate antennas on a vehicle for each frequency band is undesirable because of cost, appearance, and space limitations.

Vertical monopole whip antennas are known which can provide reception in both L-band and Band-III. Whip antennas, however, are undesirable because they create wind noise, are an unattractive protrusion, and are subject to breakage.

Conformal antennas, carried by a vehicle surface such as a window glass, are preferred for automotive vehicles for improved appearance, durability, and elimination of wind noise. However, there are several complications in attempting to design a conformal antenna which is capable of receiving terrestrial signals in both L-band and Band-III. The difficulty results, in part, from the fact that L-band and Band-III are relatively far apart from each other in frequency. Another source of difficulty is the limited space available on a window glass.

Since terrestrial broadcast signals become vertically polarized, one might consider the approach of forming a vertical quarter-wave monopole antenna on a vehicle window to receive both frequency bands. However, the vertical length for such an antenna receiving Band-III is about 350 mm. Therefore, the vertical antenna conductor would mechanically interfere with window-mounted heater wires for the window defogger which are widely used on rear windows. Placing the antenna on the front window where more space is mechanically available is undesirable because the antenna would impinge in the direct, forward-looking field of vision.

Related U.S. application Ser. No. 08/841,315, filed Apr. 30, 1997, entitled "Multiband Reception Antenna for Terrestrial Digital Audio Broadcast Bands", which is incorporated herein by reference, teaches an antenna structure that includes a loop portion for receiving at Band-III frequencies and a half-wave dipole portion for receiving at L-band frequencies. Impedance circuits in the loop portion isolate the loop portion at L-band frequencies. However, antenna gain at L-band frequencies may be too low for some applications due to reduced current flow caused by a junction within the dipole antenna portion.

SUMMARY OF THE INVENTION

The present invention has the further advantages over the prior related invention of providing a higher gain at L-Band while reducing or eliminating the need for impedance elements.

These and other advantages are obtained from the present invention wherein a multiband conformal antenna receives broadcast signals in Band-III and L-band. The antenna comprises a support surface and first and second antenna feedpoints disposed on the support surface. An open-end loop disposed on the support surface is directly connected with the first and second antenna feedpoints. The open-end loop has a loop length substantially equal to an integer multiple of a wavelength within the L-band. The open-end loop has a gap located on its periphery. A closed-end loop disposed on the support surface has a loop length substantially equal to about one wavelength within Band-III. A pair of substantially parallel lines is disposed on the support surface and is connected across the gap and to the closed-end loop. The pair of parallel lines has a capacitance substantially providing a short circuit at frequencies within the L-band.

DETAILED DESCRIPTION OF PREFERRED EMBODIMENTS

Figure 1:
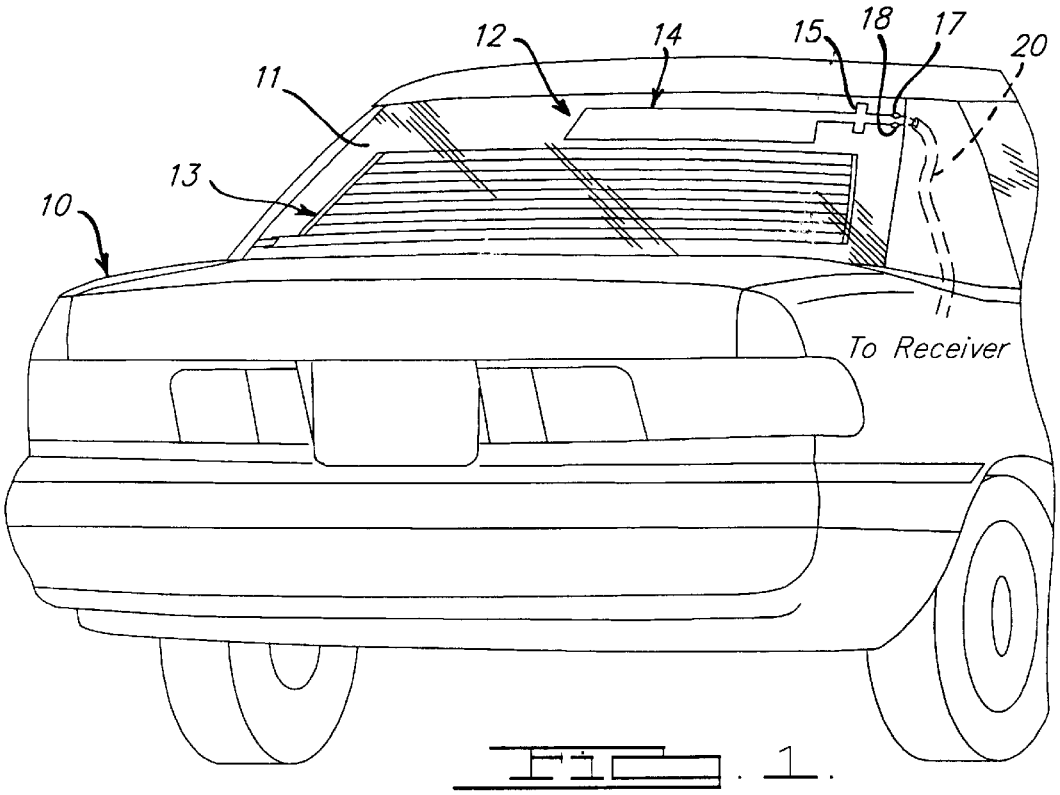
FIG. 1 is a perspective view of an automobile with a heater grid and the antenna of the present invention disposed on its rear window glass.

Referring to FIG. 1, an automotive vehicle 10 has a rear window glass or backlite 11. A multiband antenna 12 is printed on the inside of the rear glass 11. The position of the antenna is at the upper part of rear glass 11 located above a defogger 13. The antenna is shaped as a rectangular closed-end loop 14 extending horizontally across rear glass 11 for a relatively greater distance than the vertical height of the loop. A smaller open-end loop 15 is located between closed-end loop 14 and a pair of feedpoints 17 and 18. Feedpoints 17 and 18 are connected by a cable 20 to a radio receiver (not shown). The multiband antenna works as a loop antenna at Band-III (with an effective length of about one wavelength within Band-III) and as a quasi-loop antenna at L-band (with an effective length of about an integer multiple of a wavelength within the L-band). These effective lengths depend upon the dielectric constant and thickness of the window glass.

Figure 2:
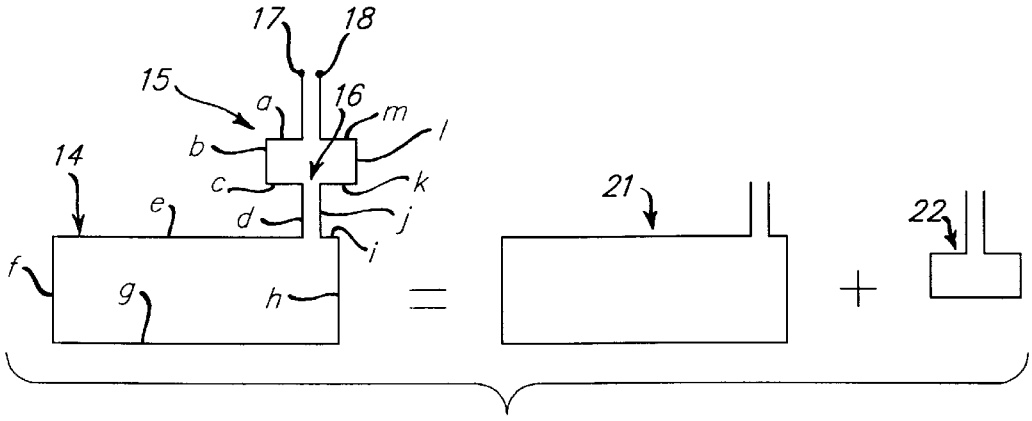
FIG. 2 is a plan view of one embodiment of the invention and equivalent circuits for L-band and Band-III signals.

FIG. 2 shows the antenna in greater detail, along with its equivalent circuits at Band-III and L-band. In this preferred embodiment, the antenna includes a plurality of segments designated a through m. Open-end loop 15 includes segments a, b, c, k, l, and m. Segment a is connected to feedpoint 17 and segment m is connected to feedpoint 18. There is a gap 16 between segments c and k. Closed-end loop 14 includes segments e, f, g, h, and i. Segments d and j form a pair of substantially parallel lines which interconnect gap 16 of open-end loop 15 with closed-end loop 14.

The antenna dimensions are selected so that the peripheral length of closed-end loop 14 (i.e., the summed lengths of segments e, f, g, h, and i) corresponds to about one wavelength in Band-III. The effective peripheral length of open-end loop 15 (i.e., the summed lengths of segments a, b, c, k, l, and m plus the gap) corresponds to an integer multiple of a wavelength within the L-band. The length and spacing between segments d and j is such that a capacitance is formed which performs substantially as a short circuit for frequencies within the L-band, so that the segments of the closed-end loop do not affect the L-band signals.

When receiving Band-III signals, closed-end loop 14 works as a loop receiving antenna while open-end loop 15 works as a transmission line since the peripheral length of open-end loop 14 is too short for E-and-III wavelength. FIG. 2 shows equivalent loop 21 for Band-III signals. When receiving L-band signals, closed-end loop 14 does not influence reception since the pair of parallel lines formed by segments d and j results in a quasi-short circuit. FIG. 2 shows equivalent loop 22 for L-band signals.

The antenna conductors can be fabricated by printing conductive pastes on the glass surface, by using a metal tape bonded to the glass surface, or by embedding conductive material within layers of the glass. The actual length of various conductors making up the antenna also depends on (e.g. is reduced by) the dielectric constant and thickness of the glass. The vertical height of the antenna is limited depending upon the vehicle on which it is installed.

By way of example, an antenna was constructed having conductor widths of 1 mm. One wavelength in Band-III is about 1300 mm. Based on a wavelength reduction by the glass of about 0.7, the peripheral length of the closed-end loop was 910 mm. One wavelength hn L-band is about 209 mm. The peripheral length of the open-end loop was 115 mm (the reduction rate was 0.55).

Figure 3:
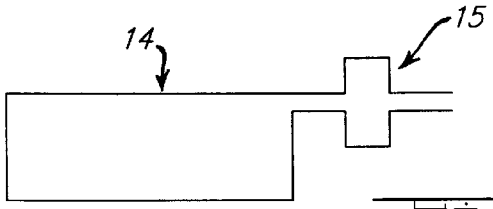
FIG. 3 is a plan view of one preferred orientation of the antenna of the present invention.
Figure 4:
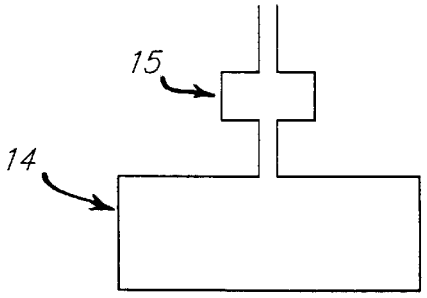
FIG. 4 is a plan view of an alternative orientation of the antenna of the present invention.
Figure 5:
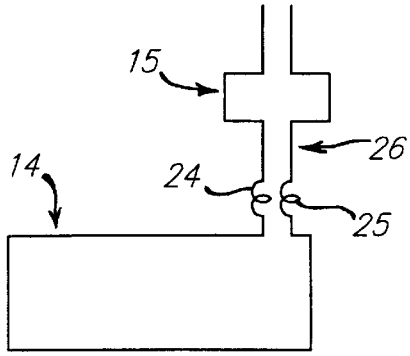
FIG. 5 shows a plan view of an alternative embodiment of the antenna using an impedance circuit.

The open-end loop can be positioned anywhere along the periphery of the closed-end loop. FIG. 3 shows a structure with the open-end loop oriented horizontally from the closed-end loop. FIG. 4 shows the open-end loop connected to the top vertical edge of the closed-end loop. Thus, it is possible using the present invention to locate the antenna feedpoints in many different locations at the edge of the window glass.

An alternative embodiment is shown in FIG. 4 wherein impedance elements 24 and 25 are inserted between closed-end loop 14 and capacitor 26 formed baa the pair of parallel lines. The impedance elements can optionally be used to cut leakage currents into the closed-end loop for L-band signals even more. Impedance elements 24 and 25 may be comprised of inductors such as a zig-zag pattern as described in copending application Ser. No. 08/841,315.

Figure 6A:
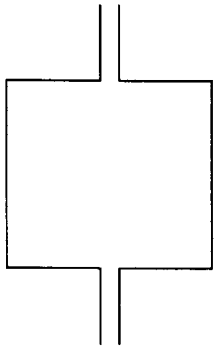
FIGS. 6A, 6B, and 6C show alternative shapes for the open-end loop of the present invention.
Figure 6B:
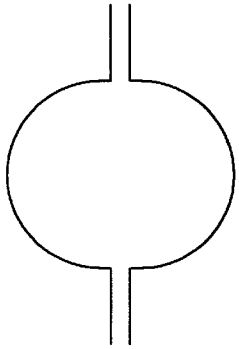
Figure 6C:
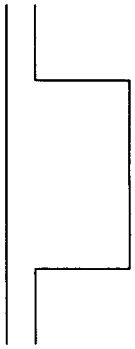

FIG. 6 shows alternative shapes for the open-end loop. FIG. 6A shows a rectangular shape which is symmetrical about a vertical centerline. FIG. 6B shows a circular shape which is also symmetrical about a vertical centerline. FIG. 6C shows an asymmetric rectangular shape.

What is claimed is:

1. A multiband conformal antenna for receiving broadcast signals in Band-III and L-band, comprising:

a support surface;

first and second antenna feedpoints disposed on said support surface;

an open-end loop disposed on said support surface directly connected with said first and second antenna feedpoints, wherein said open-end loop has a loop length substantially equal to an integer multiple of a wavelength within said L-band, and wherein said open-end loop has a gap located on its periphery;

a closed-end loop disposed on said support surface, said closed-end loop having a loop length substantially equal to about one wavelength within said Band-III; and a pair of substantially parallel lines disposed on said support surface and connected across said gap and to said closed-end loop, said pair of parallel lines having a capacitance substantially providing a short circuit at frequencies within said L-band.

2. The antenna of claim 1 wherein said support surface is comprised of a glass panel for a rear window of an automotive vehicle.

3. The antenna of claim 2 wherein said open-end and closed-end loops are comprised of conductive material deposited on said glass panel.

4. The antenna of claim 1 further comprising an impedance element coupled between said open-end loop and said closed-end loop.

* * * * *